US005167547A

United States Patent [19]

Kobayashi et al.

[11] Patent Number: 5,167,547

[45] Date of Patent: Dec. 1, 1992

[54] RUDDER FOR WATERCRAFT

[75] Inventors: Noboru Kobayashi; Yoshiyuki Kaneko, both of Iwata, Japan

[73] Assignee: Yamaha Hatsudoki Kabushiki Kaisha, Iwata, Japan

[21] Appl. No.: 753,201

[22] Filed: Aug. 30, 1991

[30] Foreign Application Priority Data

Aug. 30, 1990 [JP] Japan ..... 2-229554

[51] Int. Cl.[5] ..... B63H 11/113

[52] U.S. Cl. ..... 440/42; 440/51

[58] Field of Search ..... 440/38, 51, 40, 42, 440/43; 114/162, 163

[56] References Cited

U.S. PATENT DOCUMENTS 3,159,134 12/1964 Winnen ..... 440/43
3,976,026 8/1976 Eastling ..... 440/43
3,982,494 9/1976 Posti ..... 440/43

FOREIGN PATENT DOCUMENTS 386760 9/1990 European Pat. Off. ..... 440/40
2732671 2/1979 Fed. Rep. of Germany ..... 440/38
283593 11/1990 Japan ..... 440/43

*Primary Examiner*—Sherman Basinger
*Attorney, Agent, or Firm*—Ernest A. Beutler

[57] ABSTRACT

Several embodiments of jet propelled watercraft including steering rudders pivotally supported by the steering nozzle of the jet propulsion unit for providing a steering affect at low speeds and when coasting. The steering rudder is selectively moveable between its steering position and non-steering position so as to permit unincumbered high speed operation. An arrangement is incorporated that permits the rudder to pivot automatically from its steering position to an out of the way position when an underwater obstacle is struck.

5 Claims, 10 Drawing Sheets

RUDDER FOR WATERCRAFT

BACKGROUND OF THE INVENTION

This invention relates to a rudder for a watercraft a more particularly to a selectively operable steering rudder for a jet propelled watercraft.

The advantages of jet propulsion unit for watercraft are well acknowledged. Such jet propulsion units permit the watercraft to be employed in a very shallow body of water and have a number of other advantages. Normally, one way in which jet propelled watercraft are steered is by employing a pivotally supported steering nozzle at the discharge end of the jet propulsion unit which is steered so as to effect turning of the watercraft. This type of steering arrangement is extremely effective during most normal watercraft operation. However, when the watercraft is traveling at a relatively slow speed or when coasting, the operation of the steering nozzle may not provide sufficient force for effecting the desired steering of the watercraft.

If a conventional steering rudder is employed in conjunction with jet propelled watercraft, the steering rudder can offset some of the advantages of a jet propulsion unit. That is, the steering rudder must be submerged in the body of water in which the watercraft is operating in order to effect steering operation. However, when the steering rudder is so submerged, it can be subject to damage. Since jet propelled watercraft have the advantage of being operable in very shallow bodies of water, the use of a steering rudder will obviate this advantage. In addition, the rudder could be damaged when beaching the watercraft.

It is, therefore, a principal object to this invention to provide an improved steering arrangement for a jet propelled watercraft.

When a steering rudder is employed, in addition to the aforenoted difficulties, the steering rudder also provides unnecessary drag during high speed operation. During this high speed operation, the steering thrust of the discharge steering nozzle is more than adequate to provide the desired steering effect and, therefore, the steering rudder is in fact unnecessary and undesirable.

It is a further object to this invention to provide a steering rudder arrangement for a jet propelled watercraft that employs a conventional steering nozzle and in which the rudder may pivot upwardly to avoid damage if underwater objects are struck and which may also be selectively pivoted out of the water when traveling at high speeds and when the operation of the steering rudder is not required.

SUMMARY OF THE INVENTION

This invention is adapted to be embodied in a watercraft having a jet propulsion unit having a water inlet portion, an impeller portion and a discharge portion adjacent which a pivotally supported steering nozzle is positioned. A rudder is pivotally supported by the jet propulsion unit for movement between a submerged steering position and an elevated, generally out of the water position. Biasing means normally hold the steering rudder in its steering position. Control means are provided for selectively pivoting the steering nozzle between its steering position and its out of the water position.

DETAILED DESCRIPTION OF THE PREFERRED EMBODIMENTS OF THE INVENTION

Figure 1:
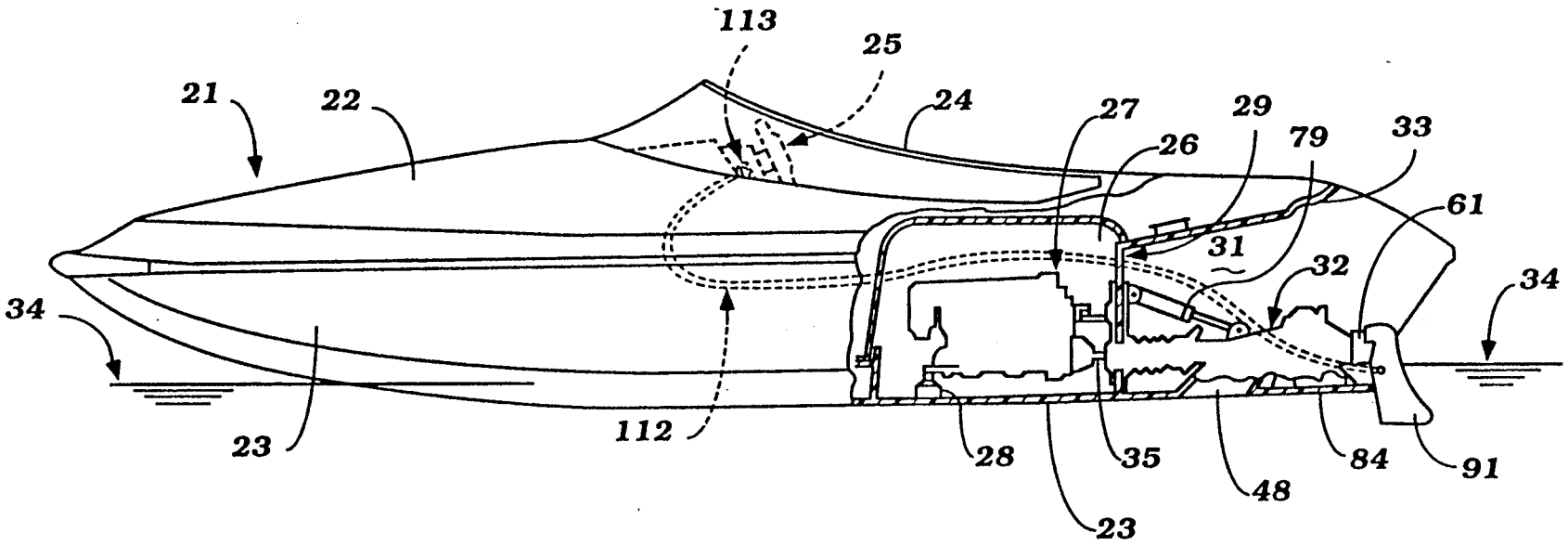
FIG. 1 is a side elevational view of a watercraft constructed in accordance with a first embodiment of the invention, with a portion broken away.

Referring in detail initially to FIG. 1, a watercraft powered by a jet propulsion unit constructed in accordance with an embodiment of the invention is identified generally by the reference numeral 21. The watercraft 21 is comprised of a hull made up of a deck portion 22 and a lower hull portion 23 which may be formed from a suitable material such as a molded fiberglass reinforced resin or the like. This hull defines a passenger area 24 that is adapted to accommodate one or more riders including an operator that controls the watercraft by means of controls such as a steering wheel 25 positioned forwardly in the passenger compartment 24.

An engine compartment 26 is positioned in the lower hull portion 23 to the rear of the passenger compartment 24 and contains a powering internal combustion engine 27 that is mounted on engine mounts 28. A bulkhead 29 is formed at the rear of the engine compartment 26 and defines a forward portion of a tunnel 31. Mounted within the tunnel 31 is a jet propulsion unit 32 which is driven, in a manner to be described, from the engine 27 for propelling the watercraft 21. The upper extremity of the tunnel 31 is defined by an upper wall 33 which separates the passenger compartment 24 from the tunnel 31.

The watercraft 21 normally rides in a body of water, indicated by the water line 34 in the figures.

Figure 2:
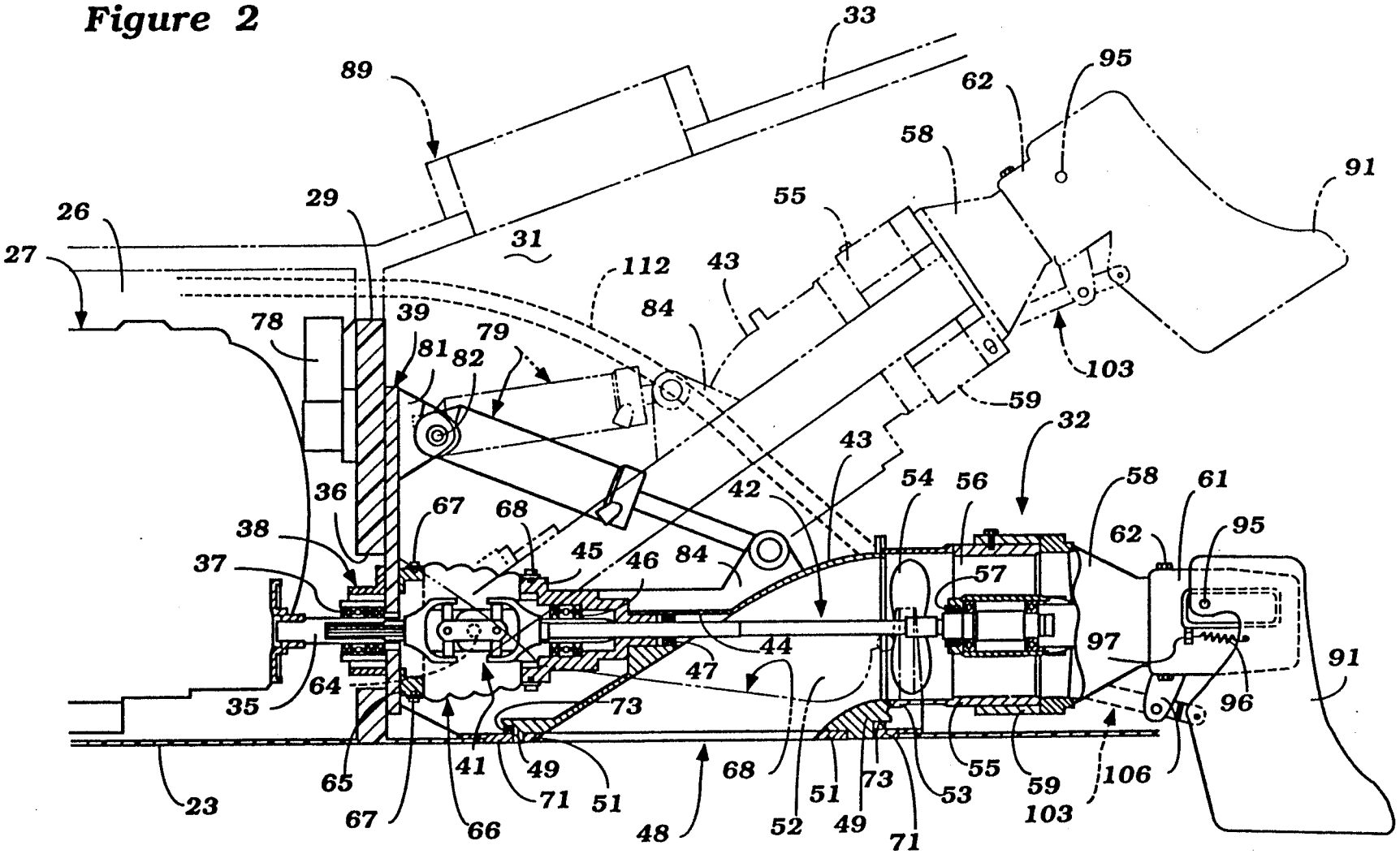
FIG. 2 is an enlarged side elevational view of the broken away portion of FIG. 1, with further components being broken away and shown in section. In this figure, the solid line view shows the jet propulsion unit in its normal operating condition and the phantom line view show the jet propulsion unit in its raised position.
Figure 3:
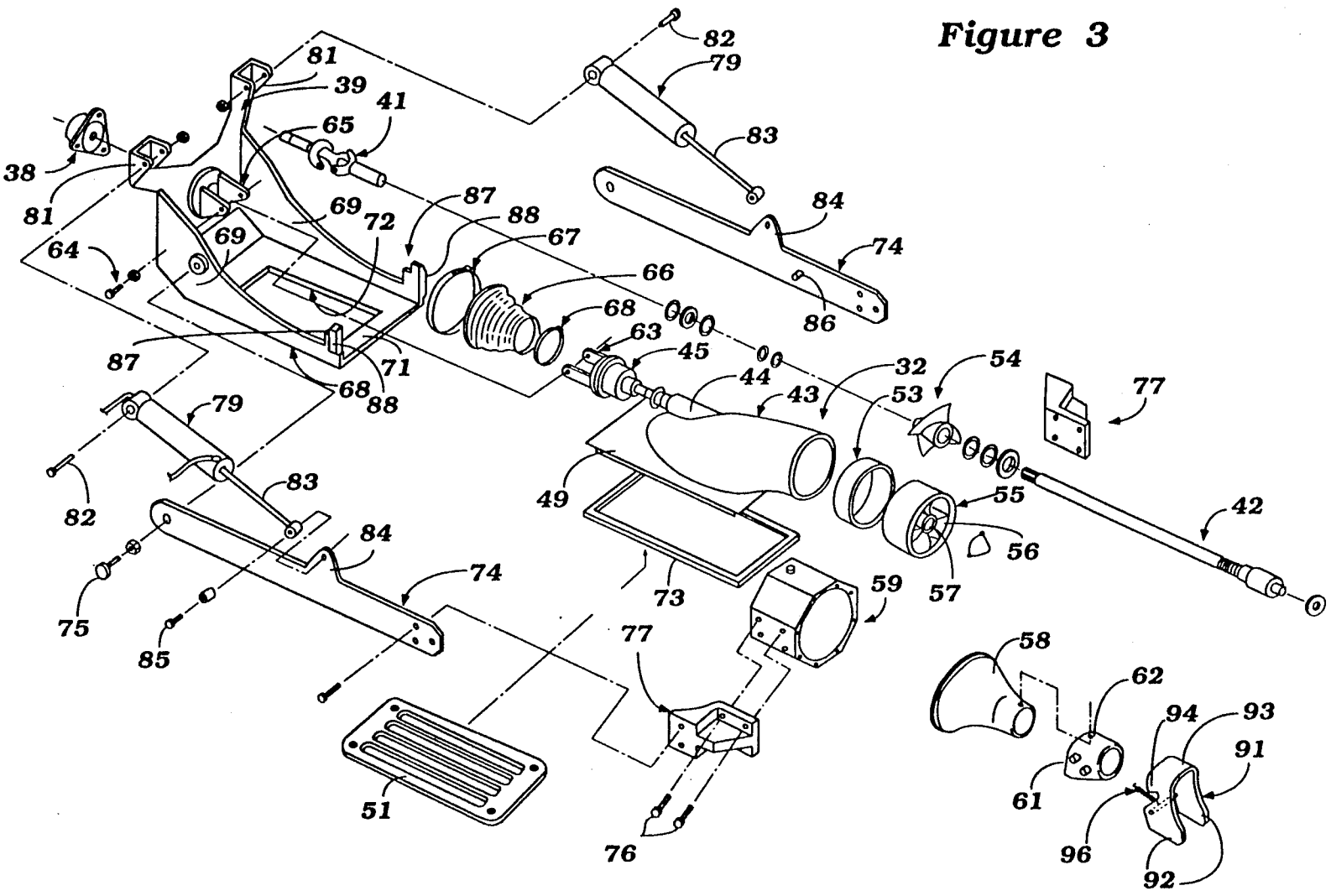
FIG. 3 is an exploded, perspective view showing the jet propulsion unit and the mounting arrangement therefore.

Referring now in detail additionally to FIGS. 2 and 3, the interrelationship between the driving engine 27 and the jet propulsion unit 32 and the construction of the latter will be described. The engine 27 has an output shaft 35 which extends through an opening 36 formed in the bulkhead 29. This shaft 35 is journalled by a bearing assembly 37 that is mounted in a bearing carrier 38 that is affixed to a combined transom plate and cradle assembly, indicated generally by the reference numeral 39. The cradle assembly 39 includes a plate like portion that affixed in a suitable manner to the rear surface of the bulkhead 29 within the tunnel 31.

Rearwardly of the bulkhead 29 and within the tunnel 31, a universal joint assembly, indicated generally by the reference numeral 41 is provided which has a splined connection to the drive shaft 35. The universal joint assembly 41, as will be apparent, is provided so as to accommodate pivotal movement between the jet propulsion unit 32 and the remaining structure of the watercraft, for a purpose to be described. The universal joint assembly 41 couples the drive shaft 35 for rotation with an impeller shaft 42 of the jet propulsion unit 32.

The jet propulsion unit 32 includes a housing assembly made up of a water inlet portion 43 having a forwardly extending pilot portion 44 into which a bearing carrier 45 is slipped. The bearing carrier 45 carries a bearing 46 and seal assembly that rotatably journals the forward end of the impeller shaft 42 where it is coupled to the universal joint 41. A further rear seal 47 is provided adjacent the bearing carrier 45 so as to seal the bearing assembly 46 from water which may enter the inlet portion 43 through a downwardly facing inlet opening 48.

As may be seen, the inlet portion 43 is defined by a generally horizontally extending flange 49 to which a grill-like inlet 51 is affixed in a suitable manner so as to permit water to be drawn into an inlet passageway 52 formed by the water inlet portion 43.

An impeller housing portion 53 is affixed to the water inlet portion 43 in an appropriate manner and an impeller 54 is affixed to the impeller shaft 42 in the impeller section 53. A tail section 55 is also affixed to the impeller housing 53 and carries a plurality of straightening vanes 56 and a bearing assembly 57 for journaling the rear end of the impeller shaft 42. Water is drawn by the impeller 57 through the downwardly facing inlet opening 48 and water inlet passage 52 and then is driven rearwardly across the straightening vanes 56.

This water is then discharged through a convergent discharge nozzle 58 which is affixed to a sleeve 59 which, in turn, encircles the impeller housing 53 and extension portion 55. A steering nozzle 61 is journalled at the rear end of the discharge nozzle 58 for pivotal movement about a vertically extending pivot axis defined by pivot pins 62. The steering nozzle 61 is connected by means of a wire actuator (not shown) to the steering wheel 25 for steering of the nozzle 61 and watercraft 21 in a well known fashion.

Normally it is the practice to mount the jet propulsion unit 32 in a fixed position within the tunnel 31 of the watercraft 21. However, this means that the water inlet portion 48 will always be underwater even when the watercraft is not being operated. As a result, barnacles and other incrustation may form in the jet propulsion unit 32 that can adversely effect its performance. In order to avoid this, the jet propulsion unit 32 is mounted for pivotal movement about a transversely extending horizontal axis from the position shown in solid lines in FIG. 2 to a raised out of the water position as shown in phantom lines in this figure. The structure for accomplishing this pivotal movement will now be described, again by primary references to FIGS. 1 through 3.

The bearing carrier 45 is formed with a pair of forwardly extending arm portions 63 that receive pivot pins 64 for pivotally connecting the impeller housing portion 43 to the cradle and transom plate 39 and specifically to a bifurcated member 65 thereof. The pivot axis defined by the pivot pins 64 is coincident with the pivot axis of the universal joint 41 so as to accommodate the pivotal movement. For protection, a flexible boot 66 encircles the universal joint 41 and is affixed to a cylindrical extension from which the member 65 is formed by means of a clamp 67. A rear clamp 68 connects the rear end of the boot 66 to the bearing carrier 45 so as to complete the enclosure and sealing of the universal joint 41 while permitting the afore described pivotal movement.

It should be noted that the cradle portion 39 has a rearwardly extending portion 68 defined by a pair of parallel side walls 69 an a lower wall 71. An opening 72 is formed in this lower wall 71 and is aligned with the water inlet opening 48 of the jet propulsion unit 32 so that water may be freely drawn into the jet propulsion unit 32. A gasket or seal 73 is carried by the flange 49 of the inlet portion 43 of the jet propulsion unit 32 and provides sealing engagement with the cradle portion 71 around the opening 72 so as to insure against water leakage and to provide good efficiency for the operation of the jet propulsion unit.

A pair of support arms 74 are pivotally connected at their forward ends by means of pivot pins 75 to the side walls 69 of the cradle portion. These arms 74 and pivot pins 75 are substantially coincident with the pivot axis defined by the pivot pins 64 and with the universal joint 41. The rear ends of the arms 75 are affixed by threaded fasteners 76 to bearing blocks 77 which are, in turn, affixed to the support ring 59.

A hydraulic motor assembly is provided for raising and lowering the jet propulsion unit 32 and this is comprised of a fluid pump driven by an electric motor 78 that is affixed to the bulkhead 29 within in the engine compartment 26. This hydraulic assembly delivers fluid under pressure selectively to a pair of hydraulic cylinders 79 which have their cylinder ends pivotally connected to trunions 81 of the transom plate and cradle 39 by means of pivot pins 82. Piston rods 83 of the fluid motors 79 are connected to upstanding projection 84 of the support arms 74 by means of pivot pins 85. As should be readily apparent, expansion and contraction of the fluid motors 79 will effect raising and lowering of the jet propulsion unit 32. The jet propulsion unit 32 is raised when the watercraft is not in operation so as to prevent the incrustation previously referred to which might otherwise occur if the jet propulsion unit was kept in the water at all times.

In order to provide added transverse support when the jet propulsion unit 32 is in its driving position, the arms 74 have a pair of inwardly extending pins 86 that are received in notches 87 formed in upstanding portions 88 of the cradle assembly 39.

In addition to be pivotal about the horizontally disposed pivot axis aforedescribed, the jet propulsion unit 32 or at least the inlet portion 43 and impeller portion 53 may be rotated about the axis of the impeller shaft 42 in a manner as described in the co-pending application of Noboru Kobayashi, entitled "Water Jet Propulsion Unit", Ser. No. 735154, filed Jul. 22, 1991, which application is a continuation of his application Ser. No. 489 361, filed Mar. 6, 1990, now abandoned, which applications are assigned to the assignee hereof. The disclosure of that application is incorporated herein by reference. If the unit is so rotatable, an access opening 89 may be formed in the hull portion 33 for accessing the water inlet opening 48 and servicing it as described in the noted co-pending application.

The use of the pivotally supported steering nozzle 61 provides very effective steering when the watercraft 21 is operating at speed. However, when operating at idle or when coasting, there is not significant discharge pressure in the steering nozzle 61 so as to effect good steering. To provide effective steering under these circumstances, the jet propulsion unit 32 is provided with a steering rudder, indicated generally by the reference numeral 91, which can be selectively placed into a steering position or placed in an above the water non-steering position.

The steering rudder 91 is, in this embodiment, formed as a generally U-shaped member having a pair of depending rudder portions 92 interconnected at their upper ends by a bridge 93. This construction appears in FIGS. 4 and 5 but also is shown in FIG. 1 through 3. As may be seen, the rudder portions 92 are provided with aligned apertures 94 that receive respective pivot pins 95 affixed to and extending outwardly from the sides of the steering nozzle 61. A pair of tension springs 96 are loaded between each of the rudder portions 92 and fixed lugs 97 carried by the steering nozzle 61 for normally holding the steering rudder 91 in its operative steering position. The springs 97 are trapped in apertures 98 formed in the rudder portions 92 for this purpose. If an underwater obstacle is struck when the rudder 91 is in its steering position, such an obstacle being indicated at 99 in FIG. 4, the springs 96 will yield and permit the steering rudder 91 to pivot about the pivot pins 95 so as to clear the obstacle 99 without any damage to the rudder 91. Once the obstacle 99 is cleared, the rudder 91 will be returned to its steering position by the springs 96.

Although the steering rudder 91 is very effective in providing steering forces when coasting or traveling at low speeds, it will provide unnecessary and undesirable drag when operating at high speed. As previously noted, the steering effect of the steering nozzle 61 is very effective at high speeds and hence the rudder 91 is not required under these circumstances. Therefore, there is provided an arrangement for pivoting the steering rudder 91 from its normal steering position to an elevated non-steering position at the selection of the operator.

Figure 6:
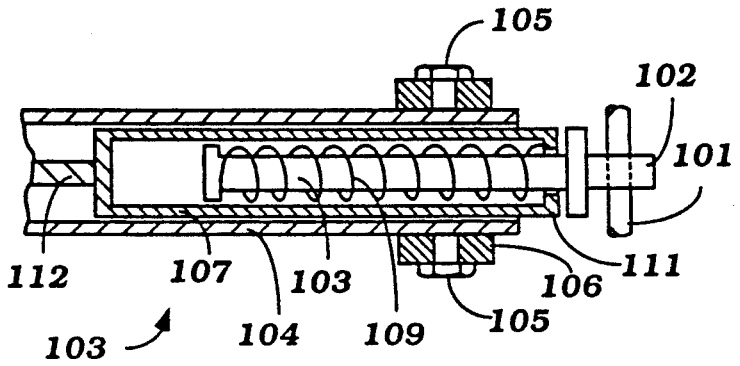
FIG. 6 is a cross sectional view showing the connection between the control and the steering rudder in one condition.

For this end, there is provided a cross pin 101 that extends between the rudder portions 92 and coupling member 102 is connected to the pin 101 and to a rod 103 which is actuated, in a means to be described, for pivoting the rudder 91 between its two positions. A mechanism as best shown in FIG. 6 and which is identified generally by the reference numeral 103 is provided for achieving this operation. The mechanism 103 includes one end of a sheath 104 which is pivotally connected by means of a pair of pivot pins 105 to a bracket 106 carried at the lower end of the steering nozzle 61.

A cylindrical plunger member 107 is slideably supported within the sheath 104 and contains a headed end 108 of the rod 103. A coil compression spring 109 acts between the headed end 108 and an end wall 111 of the cylindrical member 107 so as to normally maintain the rod 103 in the position shown in FIG. 6.

Figure 10:
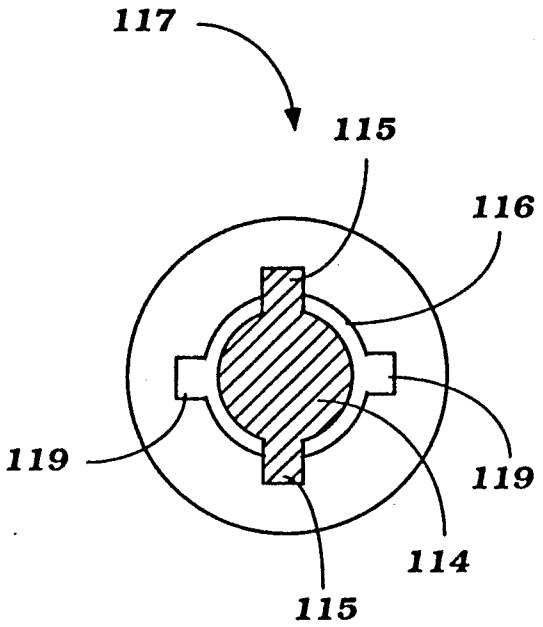
FIG. 10 is a cross sectional view taken along the line 10 —10 of FIG. 9.
Figure 9:
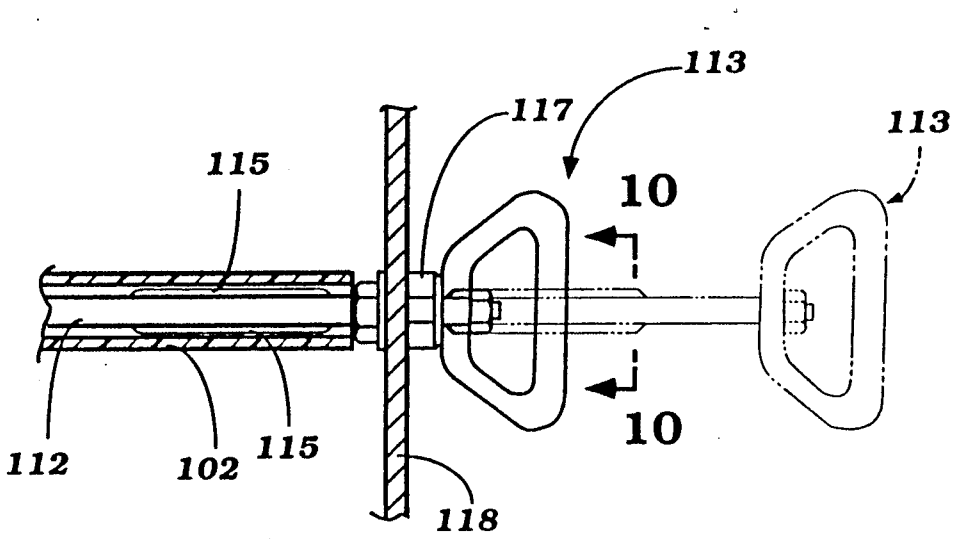
FIG. 9 is a cross sectional view showing the operator control for the steering rudder in its non-steering position as shown in solid lines and its steering position as shown in phantom lines.

A bowden wire 112 is connected at one of its ends to the cylindrical member 107. The bowden wire 112 extends through the sheath 104 upwardly through the tunnel 31 and to the passenger compartment 24 wherein it is connected to a control handle 113. The control handle 113 has a shank portion 114 with a pair of diametrically opposed lugs 115 (FIGS. 9 and 10). This shank portion passes through a cylindrical opening 116 formed in a retainer member 117 that is fixed suitable to a dash panel 118 at one end of the sheath 104 in which the wire actuator 112 reciprocates. The opening 116 is formed with slots 119 and when the handle 113 is rotated so as to aligned its lugs 115 with the slots 116, the handle 113 may be pulled outwardly to lower the steering rudder 91 in a manner to be described. The steering rudder 91 is then locked in the position by rotating the handle 113 again through 90°.

Figure 4:
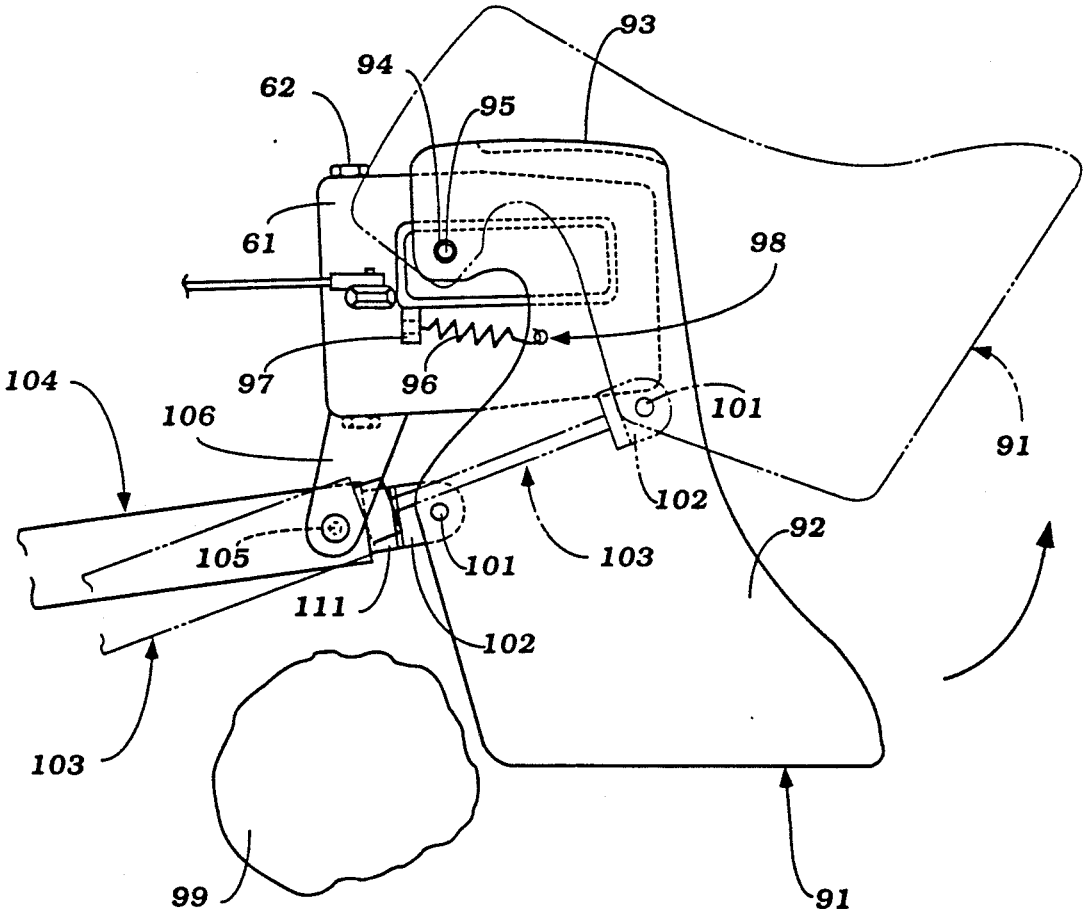
FIG. 4 is a further enlarged side elevational view showing the steering rudder and the manner in which it may pivot out of contact with an underwater object.
Figure 5:
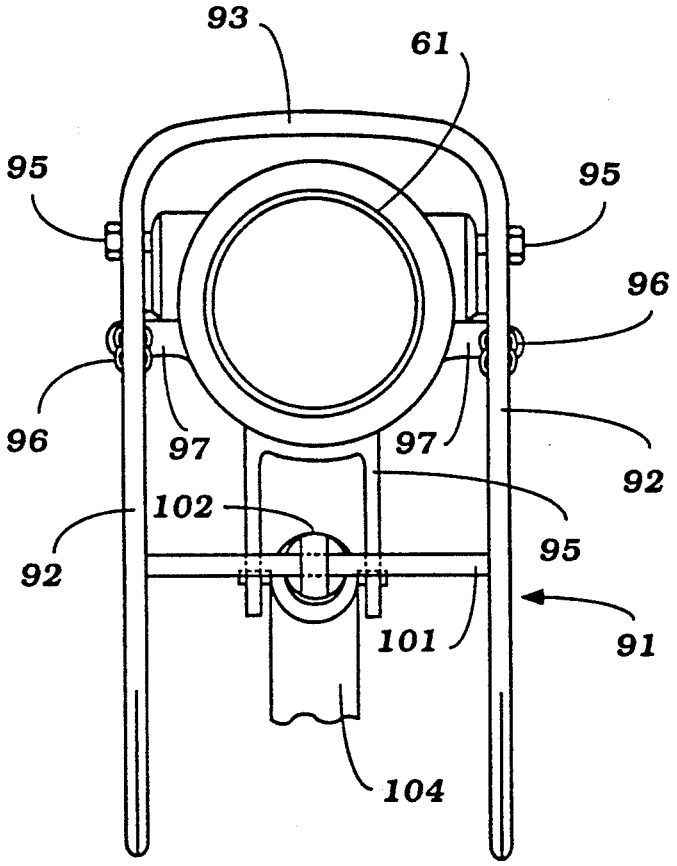
FIG. 5 is a rear elevational view of the steering rudder and its relationship to the jet propulsion unit.
Figure 7:
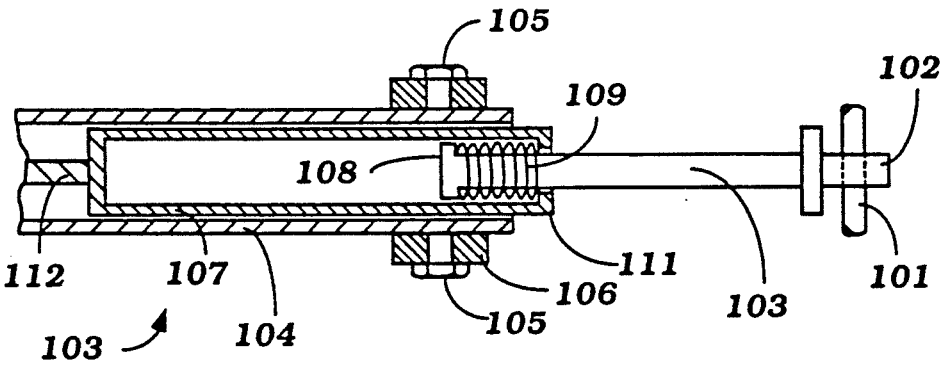
FIG. 7 is a cross sectional view, in part similar to FIG. 6, and shows the arrangement when the rudder is pivoted up due to contact with an underwater object.

The solid line view of FIG. 4 and FIG. 6 show how the mechanism appears when the steering rudder 91 has been locked in its steering position by pulling of the handle 113 to the rudder steering position as shown in phantom in FIG. 9. When this occurs, the tubular members 107 is pulled into the sheath 104 and the spring 109 will act together with this to bring the steering rudder 91 to its steering position. In addition to the spring 96 yielding when an underwater obstacle is struck, the spring 109 will also yield so that the rod 103 may move to the position shown in FIG. 7 without necessitating in concurrent movement of the operating handle 113.

Figure 8:
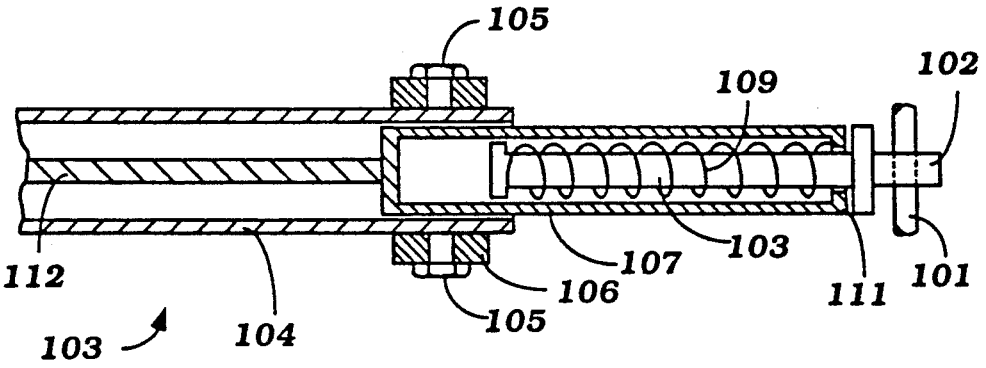
FIG. 8 is a cross sectional view, in part similar to FIGS. 6 and 7, and shows how the steering rudder may be pivoted to a raised position by the operator.

If, however, the operator wishes to move the steering rudder 91 to its out of the water position for steering operation, the handle 113 is rotated to 90° and is pushed inwardly to the solid line position shown in FIG. 9. This force on the wire actuator 112 will cause the rod 103 to be urged outwardly as the tubular member 107 slides rearwardly as shown in FIG. 8. The handle 113 is then rotated again through 90° to lock it in the non-rudder steering mode. Hence, it should be readily apparent that the described construction is very effective in permitting the operator to select whether or not the device will be operated in the rudder steering mode.

FIGS. 11 through 14 show another embodiment of the invention which, insofar as the construction of the jet propulsion unit 32 and its association with the watercraft 21 is the same as the previously described embodiment. For that reason, these portions of the construction have not been illustrated and further description of them is not believed necessary to understand the construction and operation of this embodiment.

This embodiment, however, differs from the previously described embodiment in two main regards. In the first instance, in this embodiment there is only provided a single steering rudder, indicated generally by the reference numeral 151 which is mounted, in a manner to be described, as the lower end of the steering nozzle 61. In addition, the operation of the rudder 151 is accomplished in such a way so as to avoid the necessity of the spring connection device of the type shown in FIGS. 6 through 8 including the spring 109 and sliding tubular member 107 of the previously described embodiment.

In this embodiment, a mounting bracket 152 is affixed to the underside of the steering nozzle 61 and has a bifurcated portion that receive a pivot pin 153 which pivotally supports the steering rudder 151 on the bracket 152.

The wire actuator 112 is connected directly to a bifurcated member 154 and carries at its rearward end a pin 155 that extends through an arcuate slot 156 formed in the rudder 151. A pair of coil compression springs 157 are connected at one end to the pin 155 and at their other ends to a pair of pins 158 that are affixed to opposite sides of the rudder 151.

Figure 11:
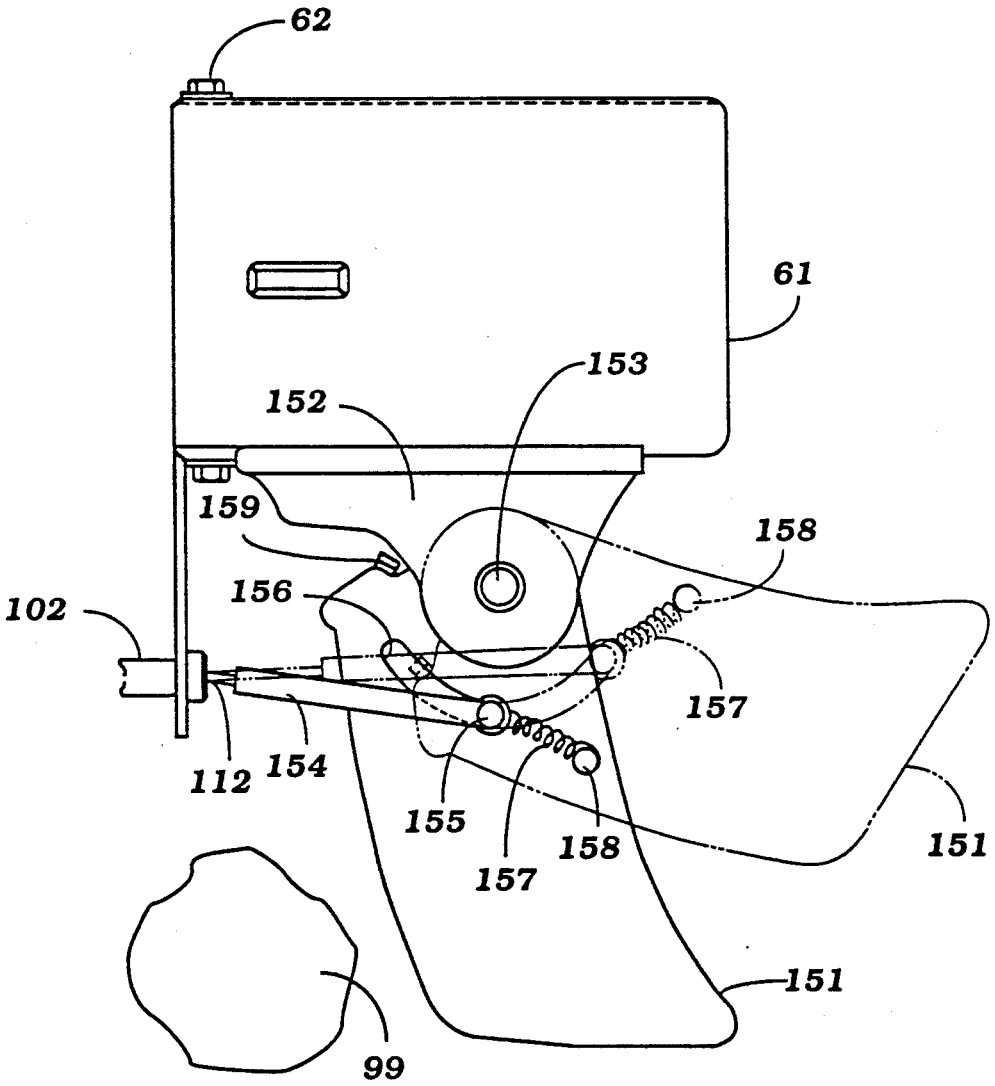
FIG. 11 is a side elevational view, in part similar to FIG. 4, and shows another embodiment of the invention.
Figure 12:
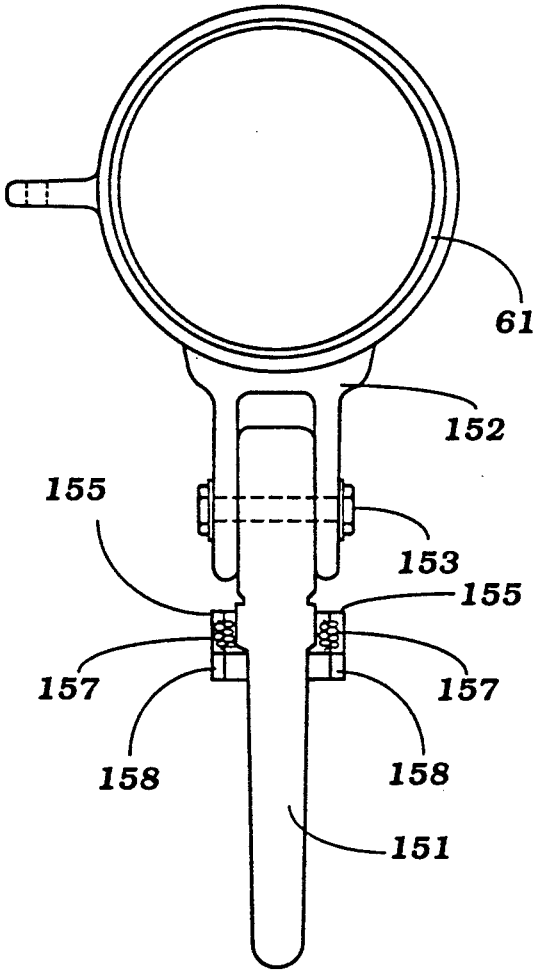
FIG. 12 is a rear elevational view of this embodiment.
Figure 13:
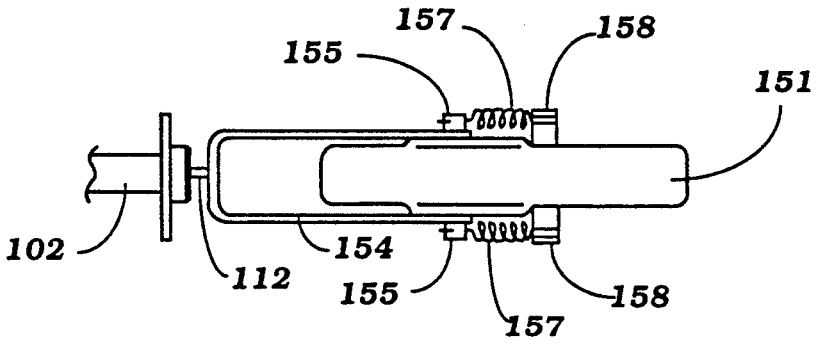
FIG. 13 is a top plan view of this embodiment.

When the handle 113 is pulled outwardly to effect rudder steering, the wire actuator 112 is pulled inwardly and pulls the yoke member 154 rearwardly to the position shown in FIG. 11. When this occurs, the spring 157 will also cause the rudder 15 to move downwardly to its normal steering position as shown in solid line view in this figure. When the underwater obstacle 99 is struck, the rudder 152 may pivot upwardly about the pivot pin 153 and cause the spring 157 to extend. When this occurs, the pin 155 will traverse the slot 156 and hence no force will be exerted on the yoke member 154. It should be noted that a fixed stop 159 may be carried by the rudder 151 that contacts the bracket 152 to set the down steering position for the rudder 151.

Figure 14:
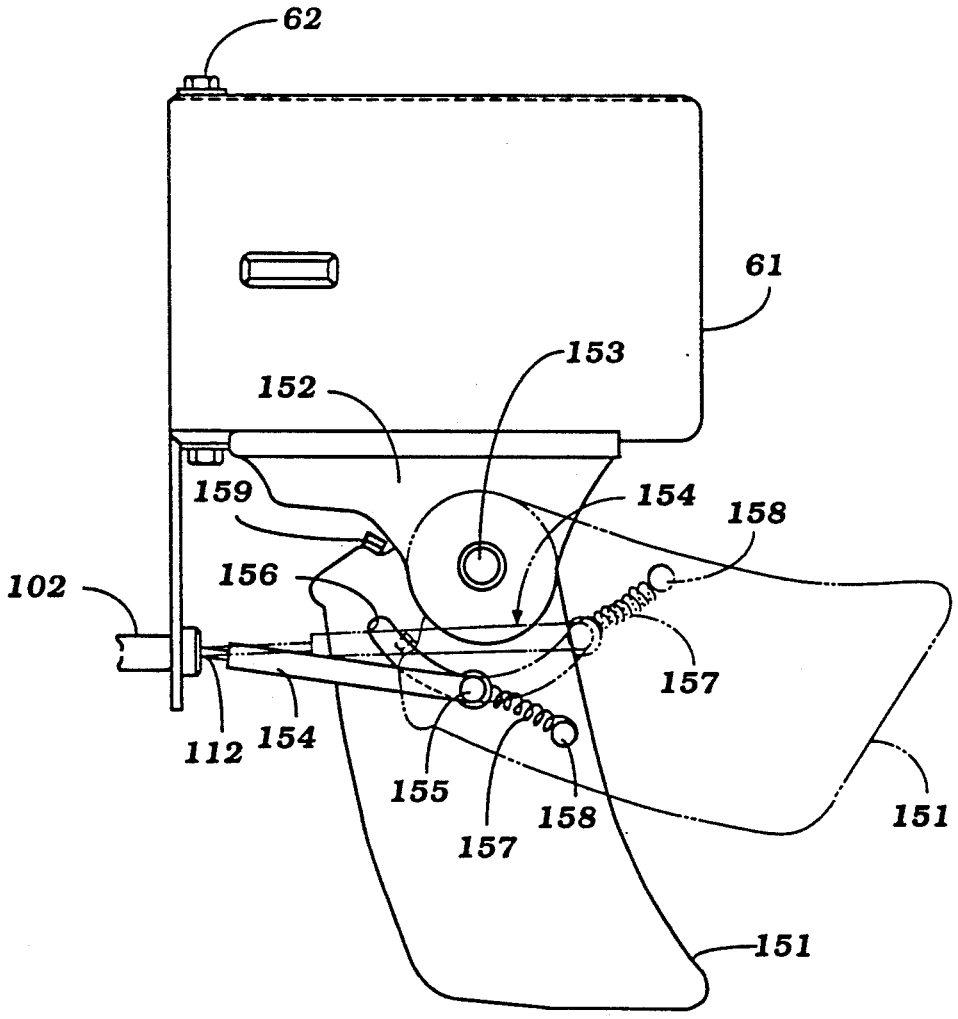
FIG. 14 is a side elevational view, in part similar to FIG. 11, and shows how the steering rudder is pivoted between its steering and non-steering positions.

If the operator desires to pivot the rudder 151 up to is non-steering position, the handle 113 is moved inwardly as previously described and a force is then exerted on the wire actuator 112 to urge it and the yoke member 154 outwardly from the solid line position shown in FIG. 14 to the phantom line view in this figure. Because the pin 155 is at the end of the slot 156, the rudder 151 will be pivoted upwardly to it raised position. When the rudder 151 in this embodiment is placed in its non-steering position, it will still be submerged in the body of water in which the watercraft is operating and hence will still create some drag. However, since the rudder is pivoted to the position shown in phantom line view in FIG. 14, the amount of this drag will be reduced and the advantages of the proceeding embodiment will be realized, although not to the same extent.

It should be readily apparent from the foregoing descriptions that the described embodiments of the invention provide a very effective rudder mechanism that can be utilized in conjunction with a jet propelled watercraft to effect steering under low speed and coasting conditions. The rudder easily can pivot up to avoid damage when striking an underwater obstacle or inadvertently left down when beaching. The operator can easily move the rudder to a non-steering position so as to permit high speed operation without interference from the rudder. Of course, the foregoing descriptions is that two embodiments of the invention and various changes and modifications may be made without departing from the spirit and scope of the invention, as defined by the appended claims.

We claim:

1. A jet propelled watercraft having a hull and a jet propulsion unit comprised of an inlet portion, an impeller portion containing an impeller for drawing water through the inlet portion, a discharge nozzle portion for receiving water from the impeller portion, a steering nozzle pivotally supported adjacent the discharge end of the discharge nozzle for steering of the watercraft, a rudder pivotally supported relative to said steering nozzle for movement between a lowered steering position and a raised non-steering position, the support for said rudder permitting said rudder to pivot from its steering position to a raised position when an underwater obstacle is struck, biasing spring means for yieldably holding the rudder in its steering position, and means for selectively moving said rudder between said positions including a lost motion connection between said means for selectively moving the rudder between the positions and said rudder for permitting said rudder to pivot upwardly when in its lower steering position to its raised position when the underwater obstacle is struck.

2. A jet propelled watercraft as set forth in claim 1 wherein the lost motion further includes biasing spring means for retaining the steering rudder in its steering position.

3. A jet propelled watercraft as set forth in claim 1 wherein the hull is provided with a tunnel at the rear end thereof and wherein the jet propulsion unit is contained within the tunnel.

4. A jet propelled watercraft as set forth in claim 3 further including means for supporting the jet propulsion unit for movement within the tunnel between a lowered driving position wherein the inlet portion is submerged in the body of water in which the watercraft is operating and a raised out of the water position.

5. A jet propelled watercraft as set forth in claim 4 wherein the jet propulsion unit is movably between its lowered and raised positions by pivotal movement about a transversely extending pivot axis.

* * * * *